United States Patent [19]

Klem

[11] 3,991,874

[45] Nov. 16, 1976

[54] AUTOMATIC FUNCTION MECHANISM FOR TYPEWRITERS

[75] Inventor: Stanley J. Klem, Cortland, N.Y.

[73] Assignee: SCM Corporation, New York, N.Y.

[22] Filed: June 23, 1975

[21] Appl. No.: 589,647

[52] U.S. Cl. ..... 197/91; 197/151; 197/181

[51] Int. Cl.[2] ..... B41J 19/62; B41J 33/02

[58] Field of Search ..... 197/82, 83, 91, 151, 197/168, 169, 181, 107, 6.7; 242/55, 57

[56] References Cited

UNITED STATES PATENTS

| | | | |
|---|---|---|---|
| 1,475,619 | 11/1923 | Barney | 197/51 |
| 1,608,279 | 11/1926 | Handley | 197/51 |
| 3,194,379 | 7/1965 | Szeluga | 197/151 |
| 3,204,746 | 9/1965 | Wolowitz | 197/181 X |
| 3,346,090 | 10/1967 | Goff et al. | 197/158 |
| 3,632,052 | 1/1972 | Read | 197/160 X |
| 3,637,060 | 1/1972 | McMahon | 197/6.7 |
| 3,643,778 | 2/1972 | Anderson | 197/151 |
| 3,729,081 | 4/1973 | Ozimek et al. | 197/181 X |
| 3,804,227 | 4/1974 | Cappotto et al. | 197/151 |
| 3,882,990 | 5/1975 | Genesio | 197/181 |
| 3,927,746 | 12/1975 | Wolowitz | 197/151 |
| 3,927,747 | 12/1975 | Wolowitz | 197/151 |
| 3,927,748 | 12/1975 | Wolowitz | 197/181 |
| 3,927,749 | 12/1975 | Wolowitz | 197/181 |

*Primary Examiner*—Edgar S. Burr
*Assistant Examiner*—Paul T. Sewell
*Attorney, Agent, or Firm*—Stanley J. Klem; Milton M. Wolson

[57] ABSTRACT

A method and mechanism for automatically performing a typewriter function such as backspacing a carriage where the backspace mechanism is actuated upon removal of an insertable and removable ribbon cartridge. Particularly adaptable to correcting typing errors, the present invention will automate the final backspacing operation that is necessary before the correct character is typed and normal typing can be continued. A modified ribbon cartridge containing error correction ribbon carries at least one abutment that engages a backspace coupled actuating mechanism upon removal of the ribbon cartridge. Therefore, automatic backspacing of the typewriter carriage occurs after a modified ribbon cartridge is inserted into the typewriter to perform an error correction operation simply by removing the error correction ribbon cartridge. Although a backspace function has been selected as the most appropriate function for actuation by the modified cartridge, other selected functions may also be actuated by the modified cartridge.

26 Claims, 4 Drawing Figures

AUTOMATIC FUNCTION MECHANISM FOR TYPEWRITERS

BACKGROUND OF THE INVENTION

The present invention relates to mechanisms for typewriters that utilize printing ribbon cartridges in general and include those of the type disclosed in U.S. Pat. No. 3,643,777 entitled TYPEWRITER RIBBON CARTRIDGE granted Feb. 22, 1972 and United States patent Application Ser. No. 150,946 filed June 9, 1971 with Carl Anderson et al. as inventors and entitled TYPEWRITER RIBBON CARTRIDGE both of which are assigned to the assignee of the instant application. The term "cartridge" as used hereinafter is defined to include any form of ribbon holder or container irrespective of configuration and the manner of insertion into the typewriter.

More particularly, the present invention relates to typewriters and to the automatic actuation of typewriter functions upon removal of the ribbon cartridge.

The term "typewriter function" is defined to include any typewriter operation which provides for the alignment of a selected platen impact point relative to the typewriter print point.

One particularly useful typewriter function that may be accomplished by the actuating mechanism of this invention is to provide an automatic backspace operation upon removal of an inserted cartridge. A typical backspace operation that may be automated by the actuating mechanism of this invention is fully disclosed in U.S. Pat. No. 3,482,671 entitled BACK SPACE MECHANISM FOR TYPEWRITERS granted on Dec. 9, 1969 with Richard Shattuck as inventor and assigned to the same assignee as the instant application. When cooperating with a modified cartridge, housing an error correction tape therein, the final manipulative step previously necessary for an error correction operation is directly eliminated.

Error correction devices require a series of sequential manual operations of the typewriter. For example, when an operator typed an erroneous character, it was first necessary to depress the backspace key to actuate the backspace mechanism, thereby repositioning the typewriter carriage to the proper printing station for making the correction. The typist would then overstrike the erroneously typed character through a correction medium to the writing paper, thereby rendering the erroneous character semi-invisible. Another backspace operation would then be necessary to again reposition the typewriter carriage to the proper printing station so that the correct character may be typed over the correction material. Therefore, a series of manipulative operations by the operator are necessary to correct each erroneously typed character. The end result of the foregoing is that the typing speed is significantly reduced relative to the amount of erroneous characters typed, thereby significantly increasing the time and the cost required for the preparation of typed material.

The present invention as applied to error correction, reduces the number of backspace operations that are necessary to perform an error correcting operation in that the final backspace operation is automated.

The invention is clearly not intended to apply only to the foregoing, but may readily be applied in conjunction with any related typewriter function.

Other advantages of the present invention will become more fully apparent from the following description, drawings, and appended claims.

SUMMARY OF THE INVENTION

The overall inventive concept disclosed below contemplates the method and means for the automatic actuation of a selected typewriter function upon removal of an insertable and removable cartridge. A selected application of the concept is an automatic backspacing mechanism which is illustrated in cooperation with a typewriter ribbon cartridge that carries an abutment and contains an error correction ribbon. The abutment is pivotally disposed on the top of the error correction ribbon cartridge and projects therefrom. During cartridge insertion, the abutment engages the automatic backspace mechanism and pivots free whereby the backspace mechanism remains inoperative. During cartridge removal, the abutment engages the automatic backspace mechanism and actuates a backspace function. A ribbon cartridge platform that is fixed in a substantially horizontal plane within the typewriter provides support and guidance for the error correction ribbon cartridge during insertion and removal. An upstanding wall of the ribbon cartridge platform carries an actuating mechanism that is coupled to a typewriter backspace mechanism. The uppermost portion of an actuating lever of the actuating mechanism projects upward into the path of the ribbon cartridge abutment when the ribbon cartridge is inserted into the typewriter. A lower portion of the actuating lever is coupled to the backspace mechanism and when the actuating lever is engaged by the abutment during removal of the ribbon cartridge, the backspace function is actuated. When an erroneous character is printed, the printing ribbon cartridge containing an inked ribbon is removed and the error correction ribbon cartridge is inserted into the typewriter.

As the error correction ribbon cartridge is inserted into the typewriter, the abutment carried by the ribbon cartridge abuts the actuating lever. The abutment pivots out of the path of the lever, passes beyond the lever, and thereafter returns to its actuable mode. At this time, no typewriter function is actuated. After the erroneous character is rendered semi-invisible by typing on the correction material, the error correction ribbon cartridge is removed and replaced by the printing ribbon cartridge. As the error correction ribbon cartridge is removed from the typewriter, the abutment, prevented from pivoting on cartridge removal, now urges the actuator level to pivot and actuate the backspace mechanism. Therefore, when the printing ribbon cartridge is re-inserted into the typewriter, normal typing can continue.

Accordingly, it is an object of the present invention to provide a method and means for automatically actuating a selected typewriter function upon the removal of an insertable and removable cartridge.

It is another object of the present invention to provide a mechanism that partially automates the backspacing operation of a typewriter when performing an operation requiring multiple backspacing, and in particular an error correcting operation.

A further object of the present invention is to automate the final backspacing operation in a typewriter after the erroneously typed character image has been removed whereby normal typing can continue without further manual backspacing.

Other objects, features, and advantages of the invention will become more apparent from the following description, including appended claims, and accompanying drawing.

DESCRIPTION OF THE PREFERRED EMBODIMENT

Although the inventive concept disclosed below may be adapted to actuate a variety of typewriter functions, the illustrated embodiment has, for the purpose of clarity and ease of description, been limited to a common and readily employed function, namely, backspacing and error correction. The principle of this invention can be readily applied to other typewriter functions utilizing the embodiment described herein as an example.

Figure 1:
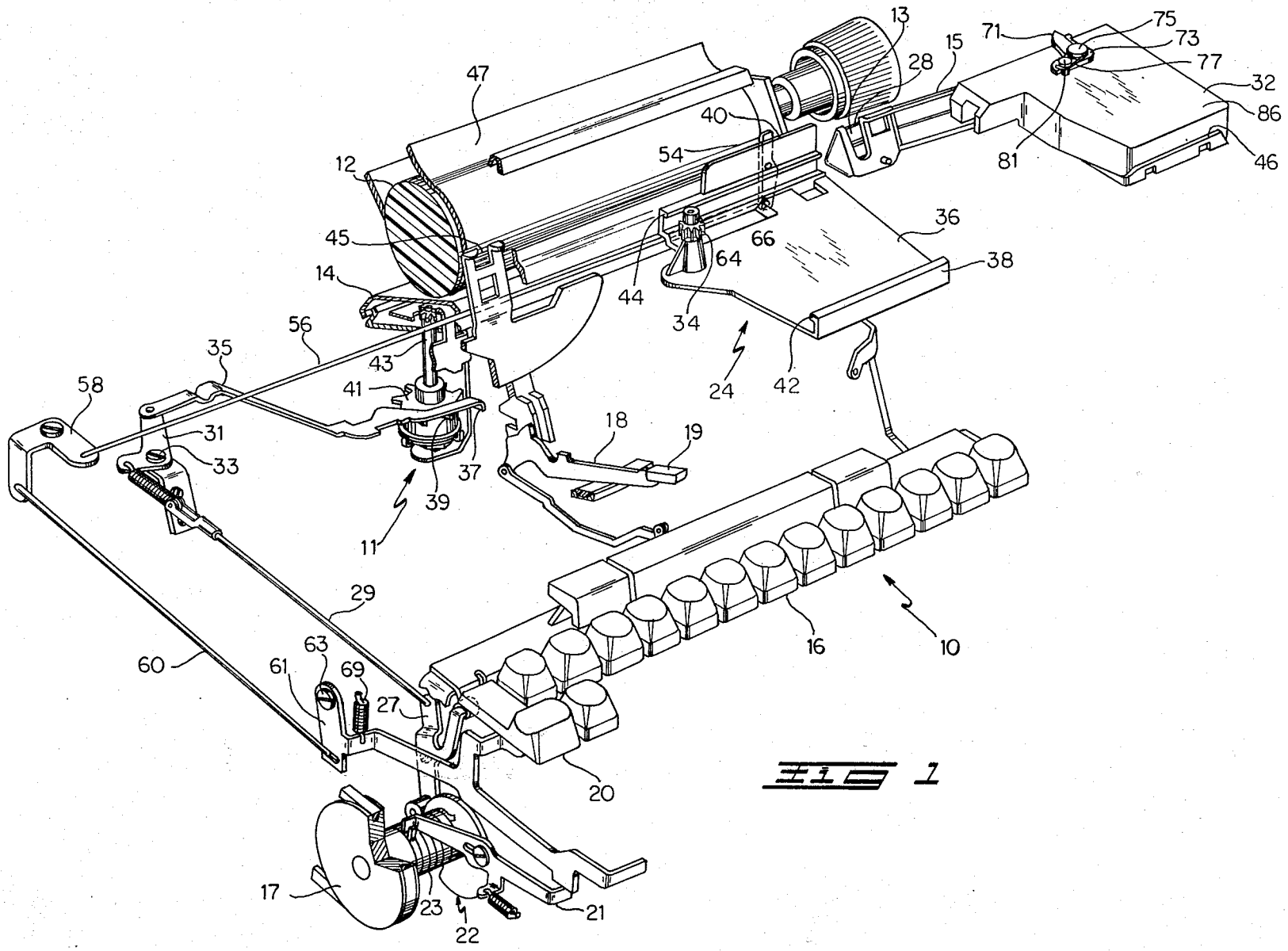
FIG. 1 is a perspective view of portions of a typewriter incorporating the invention.

The illustrated embodiment of FIG. 1 shows a typewriter 10 that includes a traversable printing platen 12 that is supported on an incrementally movable carriage 14, the movement of which is controlled by an escapement mechanism 11, such as the type that is fully disclosed in U.S. Pat. No. 2,649,179 entitled CARRIAGE FEEDING ESCAPEMENT MECHANISM and having the same assignee as the instant application. The typewriter also includes a plurality of character keys 16 for actuating a plurality of typebars 18, only one of which is shown, and a function key 20 for actuating a typewriter backspace mechanism 22.

Although a backspace function key has been selected for clarity of illustration, other function keys such as carriage return, shift, and margin release are also found in typewriters.

A ribbon cartridge platform 24 is fixed within typewriter 10, providing a support for a ribbon cartridge of the type described in the above referred to patent application assigned to the present assignee or may be readily adapted to accept a variety of structurally different cartridges. Within a cartridge housing there may be disposed a variety of ribbons including a correction ribbon 28. For the sake of clarity, only a ribbon cartridge containing error correction ribbon 28 is distinguished structurally as shown in the drawings. Ribbon cartridge platform 24 is precisely positioned to provide support for ribbon cartridges of the foregoing type so that a printing station 13 of a ribbon cartridge ribbon carrier arm 15 is in alignment with a printing station 45 of the typewriter 10 when ribbon cartridges are inserted into the ribbon cartridge platform 24. Ribbon cartridge platform 24 further includes a feed means 34 that is engageable by a ribbon cartridge to feed ribbon along an arm 15.

The structure of ribbon cartridge platform 24 as shown in FIG. 1 includes a flat base 36 having a pair of integral walls 38 and 40 extending upwards therefrom. Walls 38 and 40 are parallel to and spaced from one another to provide precise guiding for the insertion of a ribbon cartridge. Walls 38 and 40 include opposed overhanging retaining shelves 42 and 44. Shelves 42 and 44 overlie cooperating ledges 46 and 48 of the ribbon cartridges to prevent upward movement of the cartridges when they are inserted into ribbon cartridge platform 24.

The invention as embodied in the automatic backspacing mechanism most clearly shown in FIG. 1 includes an actuating lever 54 coupled to backspace mechanism 22 by a link 56, a bellcrank 58 and a link 60.

Figure 2:
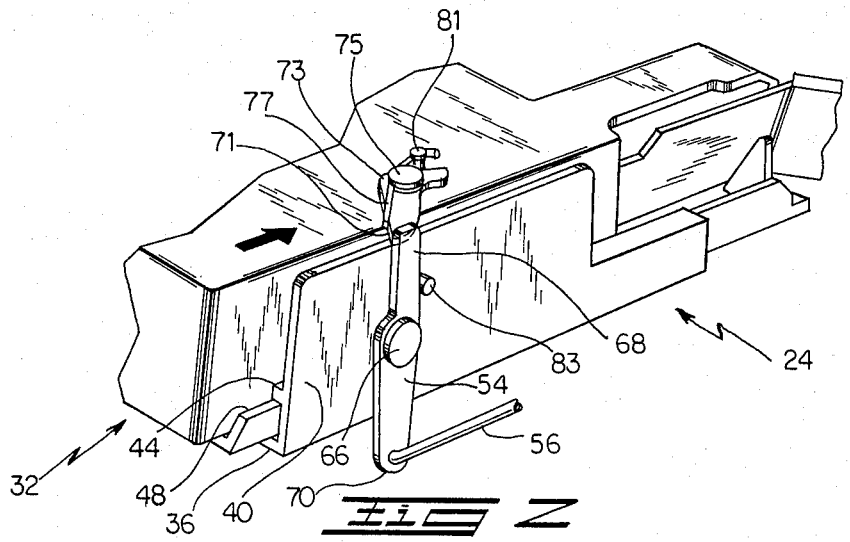
FIG. 2 is an enlarged rear perspective view of a portion of a modified ribbon cartridge as it is being inserted into the ribbon cartridge support platform.
Figure 3:
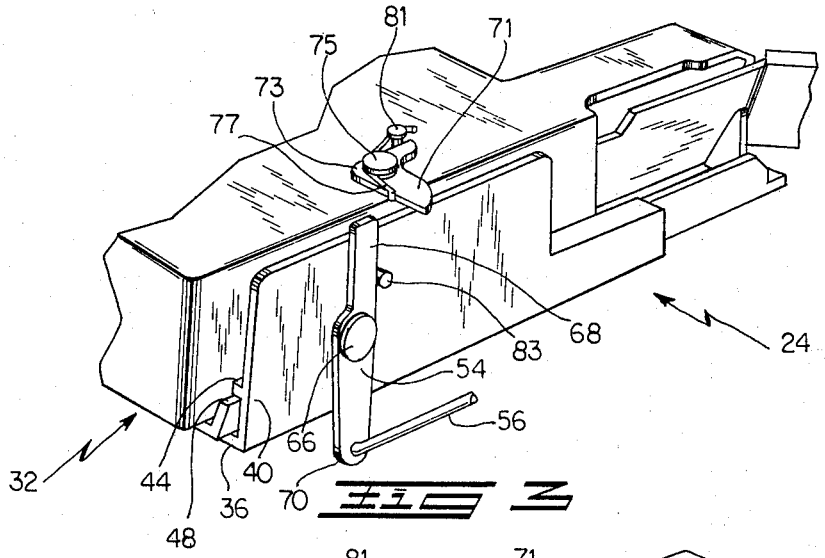
FIG. 3 is a view as shown in FIG. 2 with the modified ribbon cartridge as it is being removed from the ribbon cartridge support platform and just prior to actuating the backspace mechanism.
Figure 4:
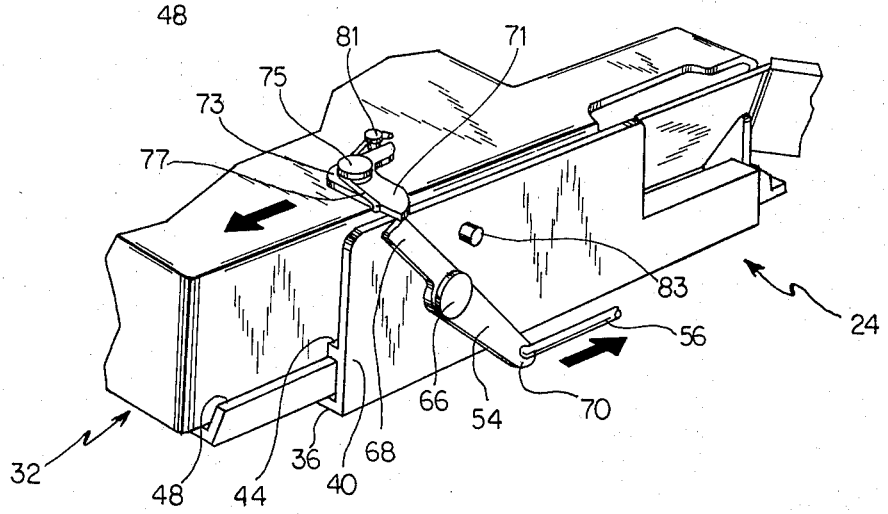
FIG. 4 is a view as shown in FIG. 3 with the modified ribbon cartridge as it is being removed from the ribbon cartridge support platform wherein the backspace mechanism is actuated.

Lever 54, clearly shown in FIGS. 2–4, is pivotally supported intermediate its ends 68 and 70 by a pivot stud 66 that projects outward from wall 40. End 68 extends upwards a sufficient distance where it intersects the insertion path of an extension 71 of a ribbon cartridge abutment 73. End 70 extends downward and has a link 56 attached thereto. Lever 54 is freely pivotal in a counterclockwise direction but non-pivotal in a clockwise direction by virtue of stop pin 83.

Link 56 connects end 70 to a bellcrank 58 and a second link 60 connects bellcrank 58 to backspace lever 61. Therefore, any movement of actuating lever 54 is linearly transmitted to actuate the backspace actuating mechanism 22. Although the linkage depicted is preferred, any other suitable mechanical linkage between lever 54 and backspace mechanism 22 may be employed.

A cartridge, preferably an error correction cartridge 32, suitable for proper actuating of the selected function is provided with a pivotal abutment 73 having extension 71 that is disposed in the path of actuating lever 54 during ribbon cartridge insertion.

In typewriters adapted for using ribbon cartridges where multiple backspacing operations are required to achieve an error correction operation, the final backspace operation required is automated by removing error correction ribbon cartridge 32 of the instant invention.

The present invention substantially automates the error correction procedure and reduces the undesirable procedure of multiple backspace operations that are normally required to correct an erroneously typed character. During normal practice when an operator types an erroneous character on a typewriter containing the automated backspace mechanism of the present invention, the following sequence of operations are required to correct the error. The operator must first remove the printing ribbon cartridge from typewriter 10 and insert error correction ribbon cartridge 32. Error correction ribbon cartridge 32 is inserted into typewriter 10 where it is supported by base 36 of ribbon cartridge platform 24 and precisely guided by platform upstanding walls 38 and 40. As error correction ribbon cartridge 32 is progressively slid along ribbon cartridge platform 24, as shown in FIG. 2, abutment 73 abuts lever 54 and lever 54 being stopped from pivoting by stop pin 83, causes abutment 73 to pivot clockwise about its pivot shaft 75. As error correction ribbon cartridge continues to be inserted, abutment 73 slides along actuating lever 54 until it is beyond the outermost point of end 68. Abutment 73 is now freely pivotal to snap upright to its actuable mode under the urge of spring 77 as shown in FIG. 3.

To accomplish an error correction operation, the following operational sequence is followed. During normal practice, when an operator types an erroneous character, carriage 14 traverses one letter space.

To correct the error, it is necessary that backspace key 20 be depressed to actuate backspace mechanism 22. The backspace mechanism 22 activates a backspace function that repositions typewriter carriage 14 to the proper position for making the correction. A backspace function occurs when backspace key 20 is depressed and an actuator bellcrank 21 is urged to pivot clockwise by the downward pivotal movement of backspace lever 61. A spring clutch 23 is thereby actuated to couple backspace mechanism 22 with a power source 17. A bellcrank 27 pivots clockwise and pulls a link 29 frontward, which in turn pivots a bellcrank 31 counterclockwise about a pivot 33. Bellcrank 31 drives a backspace link 35 toward the left, which causes a tab 37 to engage a tooth 39 of a starwheel 41 of escapement mechanism 11. Starwheel 41 rotates clockwise about a shaft 43 thereby backspacing carriage 14 one letter space. The proper position of the carriage is where the erroneously typed character is repositioned in alignment with typewriter printing station 45. The erroneous character key 16 is then depressed whereby typebar 18 carrying the erroneous type 19 would overstrike the erroneous character that was previously typed on a writing paper 47 and thereupon carriage 14 traverses one letter space. The striking of correction tape 28 within error correction ribbon cartridge 32 by typebar 18 causes white correction material from correction tape 28 to be deposited on writing paper 47 thereby rendering the erroneous typed characters semi-invisible. Error correction ribbon cartridge 32 is then removed from typewriter 10.

As error correction ribbon cartridge 32 is progressively removed from typewriter 10, abutment 73, nonpivotal in a counterclockwise direction by virtue of its contact with a stop pin 81, abuts actuating lever 54 and urges it to pivot counterclockwise as shown in FIG. 4. As actuating lever 54 pivots, link 56 is pushed left, as viewed in FIG. 1, whereupon bellcrank 58 pivots about a pivot 59 and link 60 is pulled rearward. As a result of the cooperation of link 60 and backspace lever 61, backspace lever 61 pivots clockwise about a pivot 63 and a backspace function occurs. Actuating lever 54 and backspace mechanism 22 are urged to return to their actuable state by a spring 69.

It is obvious from the foregoing description that the accomplishment of the final backspacing operation after an error correction operation has been completed by simply removing the error correction ribbon cartridge from the typewriter is a significant advantage to a typist. For example, after several backspacing operations and the covering of an erroneous typed character with correction material, no further manual backspacing is required. The operator need only remove the error correction ribbon cartridge 32 whereupon the final backspacing operation occurs, insert a printing ribbon cartridge and then continue typing, whereby the possibility of forgetting the final backspace operation is prevented.

It is clear from the above that where a typewriter is adapted with response means for actuating a selected typewriter function, the use thereof requires only the step of removing an insertable and removable cartridge.

While the foregoing description has shown and described the fundamental novel features as applied to a preferred embodiment, it will be understood by those skilled in the art that modifications embodied in various forms may be made without departing from the spirit and scope of the invention.

What is claimed is:

1. In a typewriter which includes operational means for said typewriter to perform at least one typewriter function for causing the alignment of selected platen impact point relative to the typewriter print point and having means for receiving a cartridge comprising:

means disposed in the typewriter and engageable by the cartridge for actuating said operational means upon removal of the cartridge from the typewriter to thereby perform at least a selected one of said functions.

2. In a typewriter as defined in claim 1 wherein said receiving means includes a platform fixed in the typewriter for supporting and guiding the cartridge into the typewriter.

3. In a typewriter as defined in claim 1 wherein said actuating means includes means responsive to contact with said cartridge for actuating the function when the cartridge is being removed from the typewriter.

4. In a typewriter as defined in claim 3 wherein said responsive means includes a lever pivotally carried by said typewriter in the path of travel of the cartridge when the cartridge is being inserted into and removed from the typewriter.

5. In a typewriter as defined in claim 2 wherein said typewriter further includes a function mechanism and said actuating means includes means on said receiving platform responsive to said cartridge for actuating the function mechanism when the cartridge is being removed from the typewriter.

6. In a typewriter as defined in claim 5 wherein said responsive means includes a lever pivotally disposed on a wall of the cartridge platform and in the path of travel of the cartridge for engaging the cartridge upon insertion into and removal from the typewriter.

7. In a typewriter as defined in claim 6 wherein said responsive means further includes linkage means operatively connected to the function mechanism for transmitting motion from said lever to the function mechanism only when said cartridge is removed.

8. In a typewriter as defined in claim 2 wherein said actuating means further includes means on said receiving platform responsive to contact with another surface for actuating a function mechanism upon the removal of a cartridge which cartridge is provided with a surface that will contact said responsive means.

9. The typewriter according to claim 8 wherein said means on said platform is a lever carried thereby.

10. In a typewriter having operational means to perform a carriage backspacing function and means for receiving a ribbon cartridge, that improvement which comprises:

means disposed in the typewriter and engageable by the ribbon cartridge for actuating said operational means to thereby perform the backspace function upon removal of the ribbon cartridge from the typewriter.

11. In a typewriter as defined in claim 10 wherein said receiving means includes a platform fixed in the typewriter for supporting and guiding the ribbon cartridge.

12. In a typewriter as defined in claim 11 wherein said actuating means includes an abutment disposed on a wall of the ribbon cartridge and further includes means on said receiving platform responsive to said abutment for actuating said operational means only when the ribbon cartridge is removed from the typewriter.

13. In a typewriter as defined in claim 12 wherein said responsive means includes a lever pivotally disposed on a wall of the ribbon cartridge platform and in the path of travel of the ribbon cartridge for engaging said abutment when the ribbon cartridge is removed from the typewriter.

14. In a typewriter as defined in claim 12 wherein said responsive means further includes linkage means operatively connected to said operational means for transmitting motion from said lever to said operational means.

15. In a typewriter of the type which includes receiving means for an insertable and removable ribbon cartridge and is provided with an improved backspacing mechanism, the improvement comprising:

means carried by the typewriter for operationally activating the backspace mechanism; and co-acting means carried by the ribbon cartridge for actuating said activating means of the typewriter to initiate the backspace mechanism only upon removal of the ribbon cartridge.

16. In a typewriter as defined in claim 15 wherein said activating means includes a lever pivotally disposed in the path of travel of the ribbon cartridge and said co-acting means includes an abutment disposed on the ribbon cartridge for engaging said lever when the ribbon cartridge is removed from the typewriter.

17. In a typewriter as defined in claim 15 wherein said receiving means includes a platform fixed in the typewriter for supporting and guiding the ribbon cartridge.

18. In a typewriter as defined in claim 16 wherein said activating means further includes linkage means operatively connected to the backspace mechanism for transmitting motion from said lever to the backspace mechanism only when said cartridge is removed.

19. A backspacing mechanism for typewriters that utilize ribbon cartridges, the typewriter having an incrementally traversable printing platen for supporting a printing medium, a plurality of typebars for impacting on the printing medium during traversing, a plurality of keys for actuating the typebars and other typewriter instrumentalities, a backspace mechanism responsive to another key for incrementally reversing the forward traverse of the printing platen, a ribbon cartridge platform fixed in the typewriter for supporting and guiding the ribbon cartridge into the typewriter to position a ribbon at a printing station in front of the printing medium whereby the key actuated typebars impact thereon to transfer character images through the ribbon of the ribbon cartridge to the printing medium, wherein the improvement comprises:

means on the ribbon cartridge for actuating the backspacing mechanism; and means on the ribbon cartridge platform responsive to the ribbon cartridge actuating means for actuating the backspace mechanism only when the ribbon cartridge is removed from the typewriter.

20. A backspacing mechanism as defined in claim 19 wherein said actuating means includes an abutment on a wall of the ribbon cartridge and said responsive means includes a lever that is pivotally supported on a wall of the ribbon cartridge platform and engageable by said abutment for pivotal movement relative to said platform wall.

21. A backspace actuating mechanism for a typewriter having a backspace mechanism responsive to the depressing of a backspace key, a ribbon cartridge platform fixed in the typewriter, the automatic backspace actuating mechanism comprising:

means removable from the typewriter for actuating the backspace mechanism; and means on the ribbon cartridge platform responsive to contact with said removable means for actuating the backspace mechanism independent of the backspace key.

22. A backspace actuating mechanism as defined in claim 21 wherein said removable means includes an abutment on a wall of the ribbon cartridge and said responsive means includes a lever that is pivotally supported on a wall of the ribbon cartridge platform and engageable by said abutment for pivotal movement relative to said platform wall.

23. A backspace actuating mechanism as defined in claim 22 wherein said responsive means further includes linkage means operatively connected to the backspace mechanism for transmitting motion from said lever to the backspace mechanism.

24. A method for actuating a functional operation for causing the alignment of selected platen impact point relative to the typewriter print point of a typewriter mechanism independent of a function key, which comprises:

removing a ribbon cartridge from a typewriter to thereby effect said functional operation.

25. A method for controlling the operation of a typewriter mechanism, which comprises:

moving a surface on a typewriter ribbon cartridge against a structure in the typewriter for effecting a function for causing the alignment of selected platen impact point relative to the typewriter print point of the typewriter mechanism is independent of a function key upon removal of the ribbon cartridge.

26. A method for automatically actuating the backspace mechanism of a typewriter mechanism, which comprises:

inserting a ribbon cartridge into a typewriter;

removing a ribbon cartridge from the typewriter and thereby actuating the backspace mechanism.

* * * * *